US005765625A

United States Patent [19]

Yukumoto et al.

[11] Patent Number: 5,765,625

[45] Date of Patent: Jun. 16, 1998

[54] METHOD AND APPARATUS FOR MANUFACTURING AMORPHOUS METAL RIBBON

[75] Inventors: Masao Yukumoto; Kensuke Matsuki; Nobuo Shiga; Hitoshi Ogo, all of Chiba, Japan

[73] Assignee: Kawasaki Steel Corporation, Kobe, Japan

[21] Appl. No.: 760,339

[22] Filed: Dec. 4, 1996

[30] Foreign Application Priority Data

Dec. 8, 1995 [JP] Japan ..... 7-320558
Dec. 8, 1995 [JP] Japan ..... 7-320559

[51] Int. Cl.[6] ..... B22D 11/06

[52] U.S. Cl. ..... 164/463; 164/423; 164/475

[58] Field of Search ..... 164/463, 423, 164/475, 416

[56] References Cited

U.S. PATENT DOCUMENTS 4,664,176 5/1987 Liebermann .

FOREIGN PATENT DOCUMENTS 51-109221 9/1976 Japan .
60-37249 8/1985 Japan .
1-266046 10/1989 Japan .

*Primary Examiner*—Kuang Y. Lin
*Attorney, Agent, or Firm*—Oliff & Berridge, PLC

[57] ABSTRACT

A method and apparatus for manufacturing an amorphous metal ribbon provides the following: jetting a molten metal from a nozzle, which has a slit-shaped opening, to a cooling roll, which rotates at a high speed, so as to form a puddle on the cooling roll; and spreading the puddle for rapid solidification. Additionally, the present invention provides at a position upstream from the puddle in a direction opposite the direction of rotation of the cooling roll, cleaning the surface of the cooling roll by blowing carbon dioxide gas to which ultrasonic vibration is applied.

10 Claims, 9 Drawing Sheets

METHOD AND APPARATUS FOR MANUFACTURING AMORPHOUS METAL RIBBON

BACKGROUND OF THE INVENTION

1. Field of the Invention

The present invention relates to a manufacturing method and apparatus for amorphous metal ribbons and, in particular, relates to a technique for improving the quality of amorphous metal ribbons cast using a single-roll method or the like.

2. Description of the Related Art

Recently, amorphous metal ribbons are being produced by quenching molten metals using single-roll methods, double-roll methods, or the like. When using these methods in which ribbons are directly produced from the molten metals, it is important to maintain uniform thickness and surface properties of the resultant ribbons. In particular, when the resultant amorphous alloy ribbons are layered and used as a material in, for example a transformer, the surface properties of each amorphous alloy ribbon determine the characteristics of the entire transformer. In other words, if the ribbons have a large degree of surface roughness, the weight of the metal with respect to the volume of the transformer, i. e. the space factor, decreases. Thus larger-sized transformers are required to achieve high performance.

The surface roughness of an amorphous metal ribbon (hereinafter referred to as ribbon) deteriorates (increasing in degree) because a so-called air layer absorbed onto the surface of a cooling roll (hereinafter referred to as roll), enters a boundary between a puddle of molten metal on the roll (hereinafter referred to as puddle) and the surface of the roll, and is confined within the ribbon while the ribbon is solidifying on the roll. The air layer enters the boundary according to the following mechanism: External forces vibrate the puddle and alter the wet angle between the puddle and the surface of the roll, periodically forming an air pocket into which air is readily engulfed. As a result, fish scales corresponding to the periodicity appears on the cast ribbon, thus deteriorating the surface properties of the resultant ribbon.

Numerous investigations have been conducted on the causes of puddle vibration which deteriorates the surface properties of the ribbon, and two types of vibration have been reported. One type is kinematically caused by capillary waves in which the surface film of the puddle vibrates due to collisions between air and the puddle. The other type is caused by a chemical reaction, i. e. Marangonie effect, in which the vibration of the surface film is caused by a nonuniform surface tension resulting from the surface film of the puddle being nonuniformly oxidized by the collisions between air and the puddle.

Conventionally, numerous methods have been investigated and disclosed for preventing the surface properties of the ribbon from deteriorating. For example, the air colliding with the puddle is diluted or the air is substituted with a reducing gas or an inert gas having a low density. Japanese Patent Laid-Open No. 51-109221 discloses a method in which improved alloy filaments are produced in a low-pressure chamber. Although this method is advantageous for production on a laboratory scale or for a small quantity of ribbons, the equipment costs and running costs are disadvantageously high for mass-production.

Japanese Patent Publication No. 59-209457 discloses a method addressing the equipment problem of the above method described in Japanese Patent Laid-Open No. 51-109221 by using an inert gas of a low density and at high temperature. However, since low density inert gases, e.g., helium, krypton, and xenon, which are advantageous for this method are significantly expensive, the running costs are high.

Japanese Patent Publication No. 60-37249 discloses a method in which ribbons are manufactured in an atmosphere of a low density exothermic reducing gas, which is produced by burning low-cost carbon monoxide. However, since carbon monoxide has the inherent dangers of exploding and poisoning humans, another problem occurs from a safety viewpoint.

German Patent Laid-Open No. 266046 A1 discloses an apparatus for manufacturing ribbons, in which carbon dioxide gas is provided around the puddle so as to significantly improve the surface properties of the resultant ribbons. However, according to this method, stable surface roughness (the finer the roughness the better) cannot be achieved if the ribbon has a width of more than 100 mm. In addition, although this method is suitable for manufacturing ribbons on a laboratory scale, i. e. approximately from several dozen to several hundred grams, no report has been made concerning production on an industrial scale, i. e. from several hundred kilograms to several dozen tons.

SUMMARY OF THE INVENTION

Accordingly, the present invention provides a method and an apparatus for manufacturing wide amorphous metal ribbons which have excellent surface properties and which can be produced using simple equipment with low running costs under excellent and safe working environments.

The present invention addresses the need for additional refinements to German Patent Laid-Open No. 266046, including in the form of cleaning the boundary between the surface of the roll and the puddle. The present invention provides a method for manufacturing an amorphous metal having the following steps: jetting a molten metal from a nozzle, which has a slit-shaped opening, to a cooling roll, which rotates at a high speed, so as to form a puddle on the cooling roll; and spreading the puddle for rapid solidification. According to the method, at a position upstream from the puddle, the surface of the cooling roll is cleaned by blowing carbon dioxide gas to which ultrasonic vibration is applied.

Further, the present invention provides a method for manufacturing an amorphous metal ribbon, in which carbon dioxide gas is uniformly blown to a receiving region on the surface of the cooling roll, and the flow rate of the carbon dioxide gas satisfies the following equation:

$$N \cdot W/140 \leq Q \leq N \cdot W/50$$

{wherein Q is the flow rate of the carbon dioxide gas ($m^3$/min), W is the width of the ribbon (mm), and N is the number of slits}. The receiving region on the surface of the cooling roll is a portion of the roll surface the width of which is about 1 to 1.4 times the width of the ribbon.

Furthermore, the present invention provides a method for manufacturing an amorphous metal ribbon, in which before blowing the carbon dioxide gas, the surface of the cooling roll is cleaned by blowing dry air to which ultrasonic vibration is applied and the contaminated dry air is removed by suction.

Moreover, the present invention provides an apparatus for manufacturing an amorphous metal ribbon, which apparatus comprises: a cooling roll, rotating at a high speed; a nozzle having a slit-shaped opening from which a molten metal is jetted onto the cooling roll to form a puddle; and at least one pressure head, which has a built-in ultrasonic generator and which blows carbon dioxide gas to the surface of the cooling roll provided upstream from the puddle, opposite the direction of rotation of the cooling roll.

In addition, the present invention provides an apparatus for manufacturing an amorphous metal ribbon, in which the pressure header is positioned upstream from the puddle at a circumferential distance of about 20 mm to 200 mm, inclusive, opposite the direction of rotation of thecooling roll; the length of the slit-shaped opening of the pressure header is set to about 1 to 1.4 times the width of the ribbon being cast and the depth of the slit-shaped opening is set to about 0.2 to 0.7 mm.

Additionally, the present invention provides an apparatus for manufacturing an amorphous metal ribbon, including a plurality of pressure headers are provided along the rotating direction of the cooling roll, and a suction box is provided between two pressure headers adjacent to each other and integrally formed with the pressure headers as an integral header so as to remove the used gas by suction.

Additionally, the present invention provides an apparatus for manufacturing an amorphous metal ribbon, including an air header (hereinafter referred to as separation header), which has a built-in ultrasonic generator and which blows dry air to the surface of the roll, and a suction box which removes the contaminated dry air by suction are provided upstream the pressure header, opposite the direction of rotation of the cooling roll and in which the pressure of carbon dioxide gas inside the pressure header is set to about 10 to 30 kPa.

According to the present invention, the surface of the ribbon is cleaned by a simple apparatus. Thus wide amorphous metal ribbons, in particular, ribbons 200 mm wide or greater, can be produced with excellent surface properties at low running costs under excellent and safe working environments.

DESCRIPTION OF THE PREFERRED EMBODIMENTS

Figure 1:
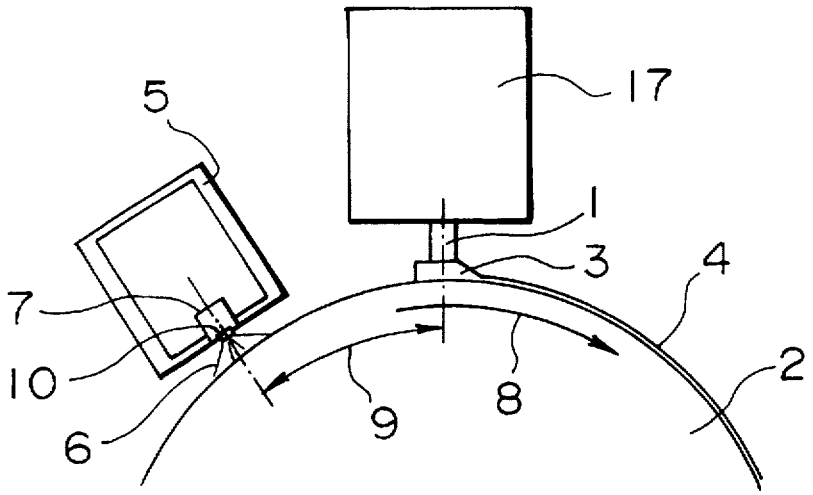
FIG. 1 is a side view illustrating an apparatus for practicing an embodiment of the present invention.

The present invention will be better understood with the following description taken in conjunction with the accompanying drawings.

In the above discussed German Patent Laid-open No. 266046 A1, the reference discloses "an atmosphere of carbon dioxide gas is provided around the puddle". It is understood providing the carbon dioxide results in the following.

The external heat of a molten metal and the like, heats and decomposes the carbon dioxide gas according to the following formula:

$$CO_2 \rightarrow CO + O \quad (1)$$

Then, an oxide film, according to equation (2), is uniformly formed on the puddle surface by highly active oxygen generated from the decomposition of equation (1).

$$(O) + (Fe, Si, B) \rightarrow (Fe_2SiO_4, SiO_2, B_2O_3) \quad (2)$$

Due to the formation of the uniform oxide film, the temperature of the molten metal is lowered at the boundary and the viscosity increases. Thus, the contact angle between a roll and the upstream portion of the puddle is near 90° and the gas is thereby bounded by the oxide film and from an area of the surface of the roll about to be covered by the ribbon. As a result, the drawing of the gas into the puddle decreases. Therefore, the gas pockets which generally occurs on the ribbon surface decrease, improving the surface roughness of the resultant ribbon.

It is further understood that the gas drawn into the puddle expanded and formed gas pockets. The formation of the gas pockets is avoidable when using a carbon dioxide atmosphere if the carbon dioxide gas is heated to 1,200° C. or more before entering the puddle so that the thermal expansion of the gas in the puddle decreases.

However, since an air layer and fine dust particles are provided such that air and fine particles are drawn by a roll rotating at a high-speed, absorbed onto the surface of the roll, and firmly fixed to the roll, they cannot be readily removed simply by providing an atmosphere of carbon dioxide around the puddle. If the air layer and fine dust particles enter the puddle, the above-mentioned effect of blowing carbon dioxide gas is impaired.

The present invention provides a method in which not only is carbon dioxide gas blown, but ultrasonic waves are applied to destroy the air layer by bombarding it with ultrasonic energy to remove the fine dust particles on the roll surface. The present invention also addresses whether blown carbon dioxide gas would be absorbed onto the roll surface. An embodiment of the present invention is shown in FIG. 1.

The apparatus includes a built-in ultrasonic generator 7 and a pressure header 5 jetting carbon dioxide gas 6 onto the surface of a cooling roll 2. According to the present invention, significant effects are achieved by positioning the apparatus with respect to the roll 2. In other words, the apparatus is positioned at a distance 9 from the puddle 3 in a direction opposite the direction of rotation 8 of the roll 2. Further, the carbon dioxide gas 6 supplied from the pressure header 5 is absorbed onto the surface of the roll 2.

In the present invention, the preferable distance 9 of the pressure header 5 is between about 20 mm and 200 mm. If the distance is less than 20 mm, the shape of the puddle 3 is impaired by the strength of the carbon dioxide gas 6 jetted from the pressure header 5, resulting in deterioration of the properties of a ribbon 4. If the distance is 200 mm or more, the air layer above the roller 2, which has been destroyed by the ultrasonic waves, is reabsorbed and, further, the concentration of the carbon dioxide gas 6 around the puddle 3 is 10% or less (the rest of the atmosphere is air), thus no improvement is attained in the properties of the resultant ribbon 4. FIG. 1 also shows a casting nozzle 1 and a tundish 17.

In general, ultrasonic generators having a rating of about 100 to 200 db (about 800 to 1,500 W/m$^2$) at 20 to 50 kHz are used and those having a rating of about 900 to 1,100 W/m$^2$ at 30 to 40 kHz are preferable. Exceedingly high power results in turbulent flow, while exceedingly low power cannot destroy the air layer.

Figure 2:
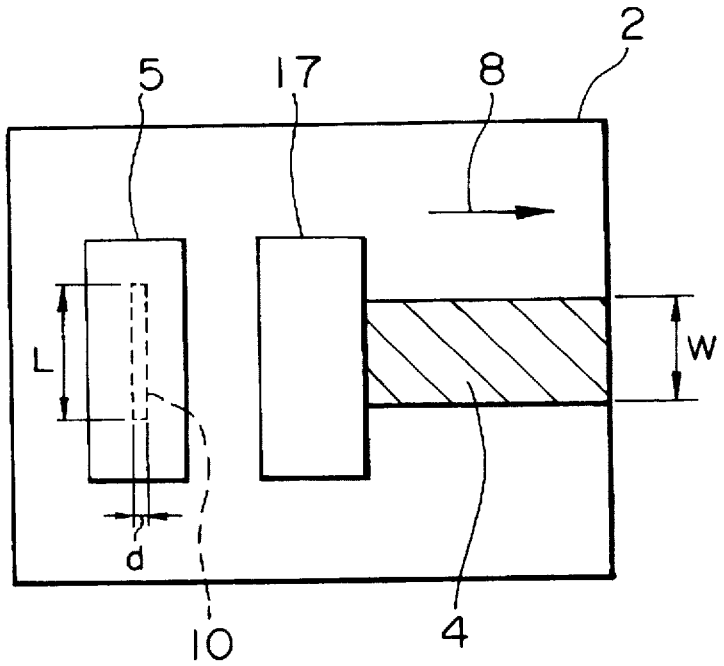
FIG. 2 is a plan view of FIG. 1.

It is understood through the present invention that if the width of the ribbon 4 is 100 mm or more, the carbon dioxide gas 6 does not uniformly blow over the surface of the roll 2, thus decreasing the blowing effect. To address this problem, the present invention effects a blowing technique according to which the carbon dioxide gas 6 reaches the positions corresponding to both edges of the ribbon 4. FIG. 2 is a plan view of an embodiment of the above technique. As an exit for carbon dioxide gas 6, a slit-shaped opening 10 is provided within a pressure head 5. In practice, a length L of the slit-shaped opening 10 was set to about 1 to 1.4 times a width W of a ribbon 4 to be cast and a depth d of the slit-shaped opening 10 was set to about 0.2 to 0.7 mm. Another parameter of the blowing effect is addressed in setting the pressure of the carbon dioxide gas 6 inside the pressure header 5 from about 10 kPa to 30 kPa. According to the present invention, the length L of the slit-shaped opening 10 is preferably set to about 1 to 1.4 times the width W of the ribbon 4. If the length L of the slit-shaped opening 10 is less than the width W of the ribbon 4, the carbon dioxide gas 6 is insufficiently blown over the portions of the roll 2 corresponding to both edges of the ribbon 4, thus decreasing the blowing effect. Further, since the intensity of the ultrasonic energy applied to the carbon dioxide gas 6 is reduced by both edges of the slit, the length L of the slit-shaped opening 10 is preferably set to the same value as the width W of the ribbon 4 or greater. If the length L of the slit-shaped opening 10 is more than 1.4 times the width W of the ribbon 4, the blowing effect is saturated, and therefore, the blowing effect is not affected by any further increase in the length L. Further, if the length L is too great the carbon dioxide gas 6 is blown onto the puddle 3 around a nozzle 1 so that it disturbs the shape and cools the puddle 3. This causes the surface properties of the resultant ribbon 4 to deteriorate.

According to the present invention, the depth d of the slit-shaped opening 10 is preferably set to about 0.2 to 0.7 mm. If depth d exceeds 0.7 mm, the flow rate of the carbon dioxide gas 6 required to achieve ultrasonic vibration in the slit-shaped opening 10 significantly increases, thus it becomes difficult to generate ultrasonic waves. When the depth d is less than 0.2 mm, processing of the slit-shaped opening 10 is difficult and the carbon dioxide gas 6 is nonuniformly blown in the length direction of the slit-shaped opening 10.

According to the present invention, the pressure of the carbon dioxide gas 6 inside the pressure header 5 is preferably set to about 10 kPa to 30 kPa. If the pressure is less than 10 kPa, ultrasonic waves are not generated. When the pressure is more than 30 Kpa, although the generated ultrasonic energy increases, the properties of the resultant ribbon 4 are not affected by variations in pressure. In particular, if the pressure is more than 30 kPa, the carbon dioxide gas 6 is blown to the puddle 3 from around the nozzle 1 so that it disturbs the tailing shapeof the puddle 3. Thus the surface properties of the ribbon 4 deteriorate.

Moreover, the present invention improves the above blowing effect of the carbon dioxide gas 6 by selecting an appropriate flow rate for the gas. In other words, by taking all operation factors affecting the properties of the ribbon 4 (e. g. the length L and the depth d of the slit-shaped opening 10 of the header 5, the number of slits, the width W of the ribbon 4, and the peripheral velocity of the roll 2) into consideration, the inventors obtained the optimum range for the carbon dioxide flow rate shown as follows:

$$N \cdot W/140 \leqq Q \leqq N \cdot W/50$$

wherein Q is the flow rate of the carbon dioxide gas (Nm$^3$/min), W is the width of the ribbon (mm), and N is the number of slits. When a plurality of headers are employed, a plurality of slits perpendicular to the moving direction of the ribbon 4 are formed.

Figure 3:
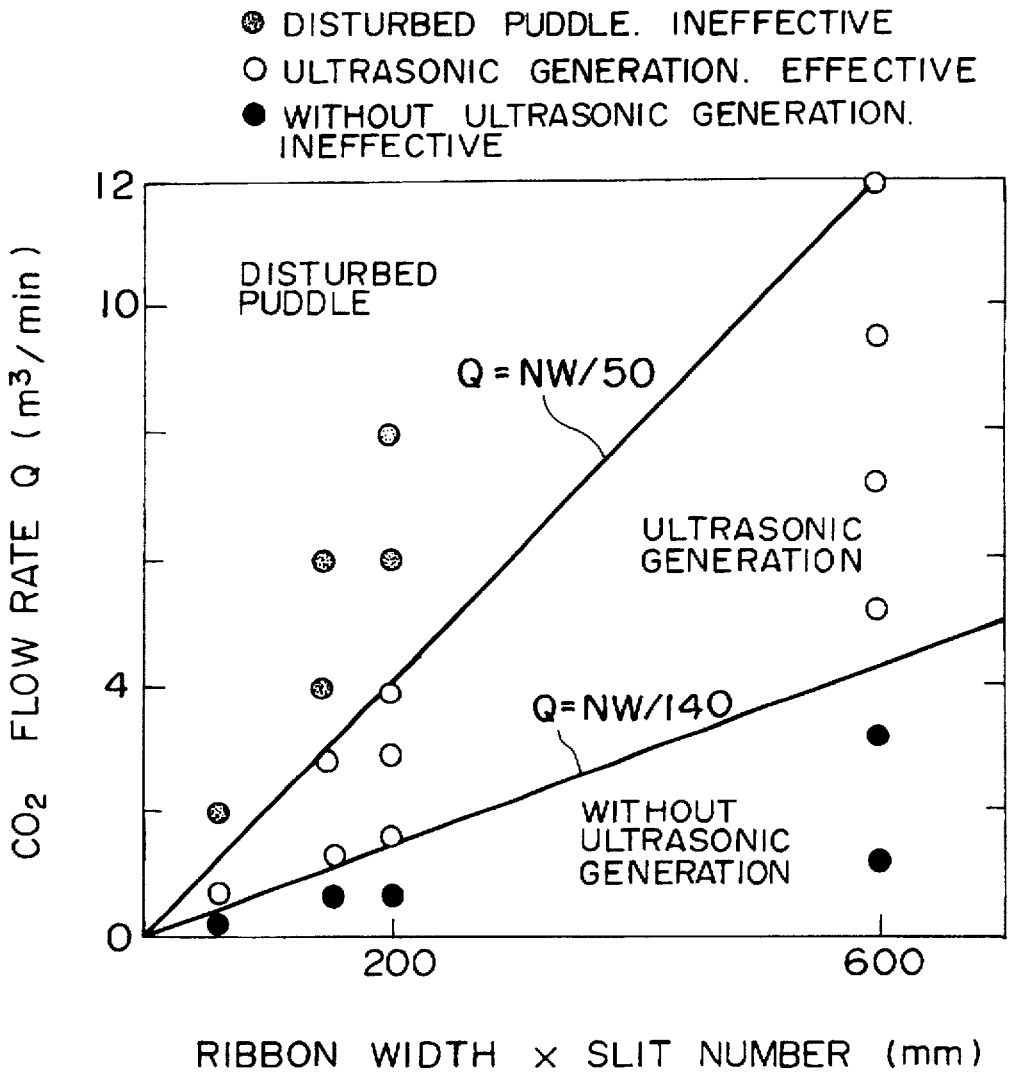
FIG. 3 illustrates the results of a study conducted for determining the optimum flow rate of the carbon dioxide gas.

FIG. 3 shows the results of the study conducted to obtain the above equation. The blowing effect of the carbon dioxide gas 6 was recorded at various flow rates when the ribbon 4 was formed with a width W of 200 mm or 50 mm and one or three slit-shaped openings were prepared such that the length L was the same as the width W of the ribbon 4 and the depth d was fixed at 0.5 mm. The value 50 on the abscissas indicates a 50 mm wide ribbon×one slit, the value 150 indicates a 50 mm wide ribbon×three slits, the value 200 indicates a 200 mm wide ribbon×one slit, and the value 600 indicates a 200 mm wide ribbon×three slits.

It is apparent from FIG. 3 that if the flow rate Q is less than N·W/140, no ultrasonic waves are generated and no cleaning effect on the roll 2 can be expected because the carbon dioxide concentration in the gas collected after blowing is less than 20% (the residual is air). In practice, the surface properties of the resultant ribbon 4 were not improved. If the flow rate Q is more than N·W/50, the carbon dioxide gas 6 is blown exceedingly strong so that the puddle 3 is disturbed and the surface properties of the ribbon 4 deteriorate. Therefore, according to the present invention, the flow rate Q of the carbon dioxide gas 6 should preferably satisfy the above equation.

Figure 4:
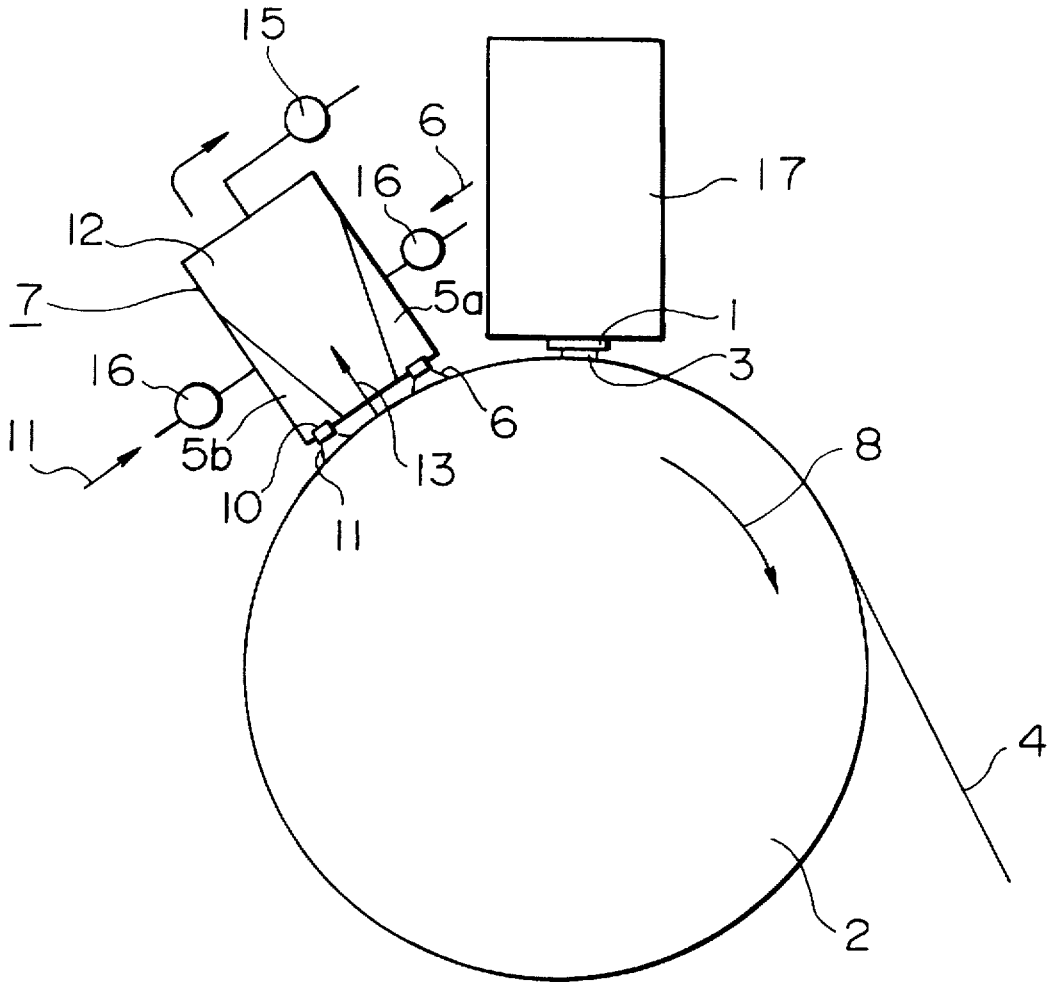
FIG. 4 is a side view illustrating an apparatus for practicing another embodiment of the present invention.

In addition to the above technique, the present invention provides a feature wherein the air layer could be removed or the amount of the fine dust particles could be decreased before blowing the carbon dioxide gas 6, as is shown in FIG. 4. In the present invention, to realize this idea, ultrasonic waves are applied to dry air 11 to destroy the air layer by bombarding it with ultrasonic energy and also to keep the fine dust particles from the surface of the roll 2. Thereafter, the air layer, the fine dust particles, and water vapor, which are deprived beforehand, are immediately removed by suction, and then the carbon dioxide gas 6 is blown so that it is uniformly absorbed onto the surface of the roll 2 to clean the surface around the puddle 3. The ultrasonic waves are also generated in the carbon dioxide gas 6 to destroy the residual air layer and further improve the absorption of the carbon dioxide gas 6 onto the surface of the roll 2. Dry air is preferably used because the densities and dew points of other gases are unsuitable for obtaining advantageous ultrasonic waves. After being used, the dry air is sucked away to obtain a constant discharging flow of air and to rapidly remove contaminated air so that the carbon dioxide gas is readily absorbed onto the surface of the roll 2.

In addition, according to the present invention, an apparatus shown in FIG. 4 provides for rapidly conducting the above consecutive cleaning procedures in the given order. FIG. 4 shows a header including a built-in ultrasonic generator 7, a plurality of pressure headers 5 for blowing gas, a suction box 12 which is provided for sucking and removing the used gas and which is integrally formed with two pressure headers 5 adjacent to each other. By the use of this integral header, it becomes possible to blow dry air 11 from one of the headers 5*a* positioned upstream, to suck and remove the used air by the suction box 12, and to blow the carbon dioxide gas 6 from another one of the headers 5*b* positioned downstream relative to header 5*a*. As a matter of course, the integral header may be used for blowing only carbon dioxide gas.

Figure 5:
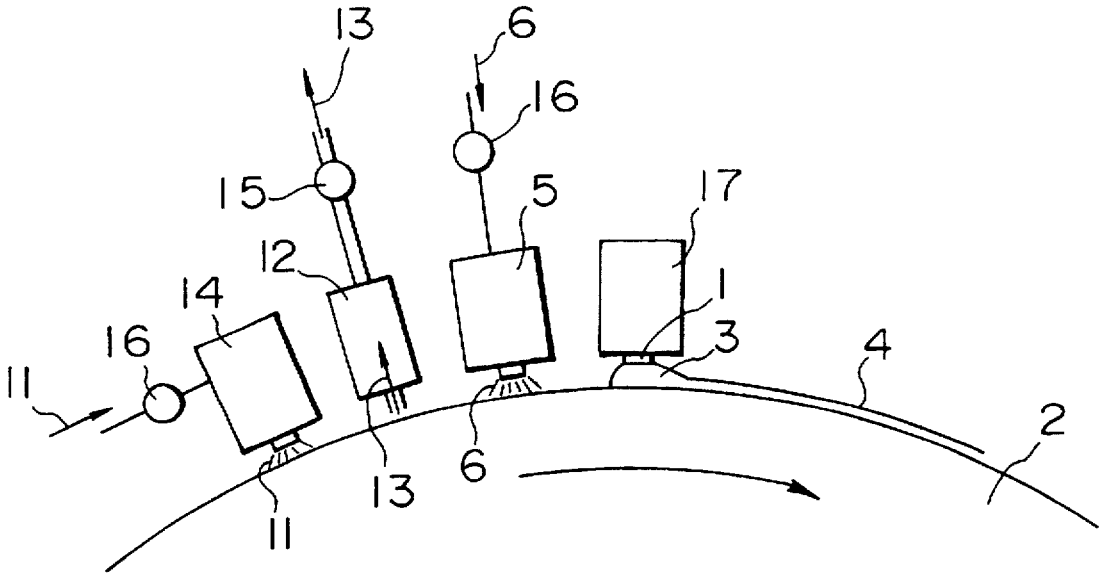
FIG. 5 is a side view illustrating an apparatus for practicing another embodiment of the present invention.

FIG. 4 also shows a suction blower 15 and a blast blower 16, where the gas is sucked in direction 13. As is shown in FIG. 5, according to the present invention, an air header 14 used for blowing dry air 11 may be formed separately from a pressure head 5 used for blowing carbon dioxide gas 6.

EXAMPLE 1

FIG. 1 shows an apparatus for manufacturing ribbons incorporated into the present invention. Using the apparatus, ribbons 4 were cast from a molten metal alloy under the following conditions:

Molten metal: $Fe_{80}B_{10}Si_9C_1$ (atomic %)

Temperature: 1,300° C.

Length of the slit-shaped opening of the casting nozzle (width W of the ribbon): 200 mm Outer diameter of the roll (made of a copper alloy and cooled by water): 1 m Peripheral velocity of the roll: 25 m/sec Length L of the slit-shaped opening of a pressure head: 150 mm Depth d of the slit-shaped opening of the pressure head: 0.3 mm Gas pressure inside the pressure head: 0.2 kgf/cm$^2$ The cleaning means of the roll surface, i. e. the pressure header 5 of the carbon dioxide gas 6 having the built-in ultrasonic generator 7, was positioned upstream the puddle 3 at a circumferential distance of 50 mm in a direction opposite the direction of rotation of the roll 2. The flow rate for blowing the carbon dioxide gas 6 was 0.8 Nm$^3$/min, and 1 kW/m$^2$ (150 db) of ultrasonic waves were applied at 25 kHz. After blowing, the concentration of the carbon dioxide gas in the atmosphere was 20% (the residue was air) at the puddle position.

As a result of the air layer absorbed onto the surface of the roll 2, an approximately 10 μm thick layer was destroyed by a so-called knife effect of the carbon dioxide gas, and another 10 μm thick layer was destroyed by the ultrasonic effect. The resultant ribbons 4 consistently provided a surface roughness Ra of less than 0.8 μm.

Figure 6:
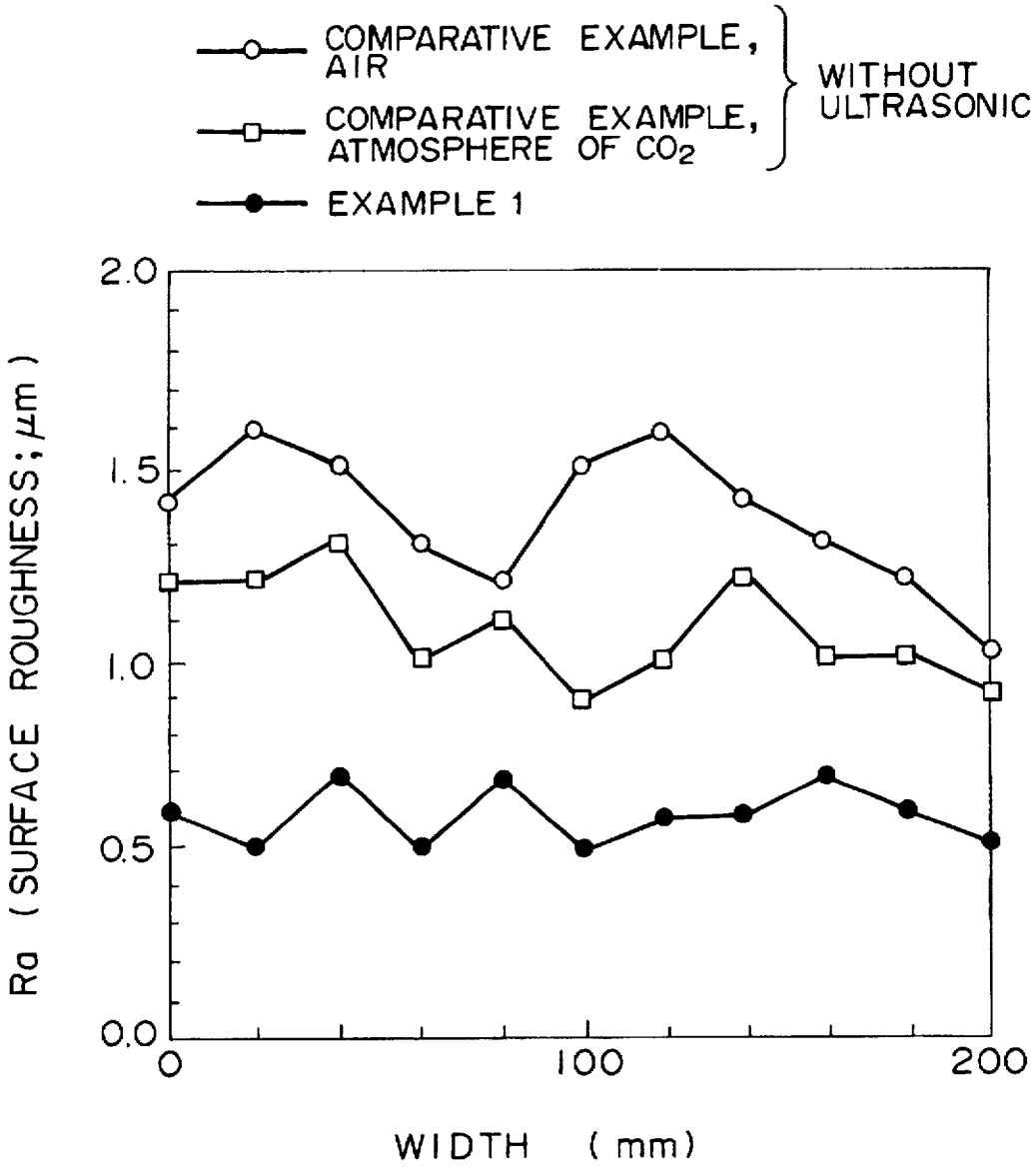
FIG. 6 is a graph showing the surface roughness distribution, of a first example of a ribbon produced by practicing an embodiment of the present invention.

FIG. 6 also shows the results obtained from two Comparative Examples. The carbon dioxide gas was used in one Comparative Example and air was used instead of the carbon dioxide gas 6 in the other Comparative Example. The blowing effect of the carbon dioxide gas is apparent from these results.

EXAMPLE 2

Ribbons 4 were cast from a molten metal alloy under the same conditions as those of Example 1, except that the following conditions were changed so that the carbon dioxide gas 6 was blown to a certain region of the surface of the roll 2, which region was larger than that of Example 1.

Length L of the slit-shaped opening of a pressure head 5: 220 mm

Depth d of the slit-shaped opening of the pressure head 5: 0.5 mm

As a result, of the air layer absorbed onto the surface of the roll 2 an approximately 10 μm thick layer was destroyed by a so-called knife effect of the carbon dioxide gas, and another 10 μm thick layer was destroyed by, the ultrasonic effect. As is shown in FIG. 7, the surface roughness Ra of the resultant ribbons 4 was so improved that the equation of Ra<0.8 μm was reliably-attained.

Figure 7:
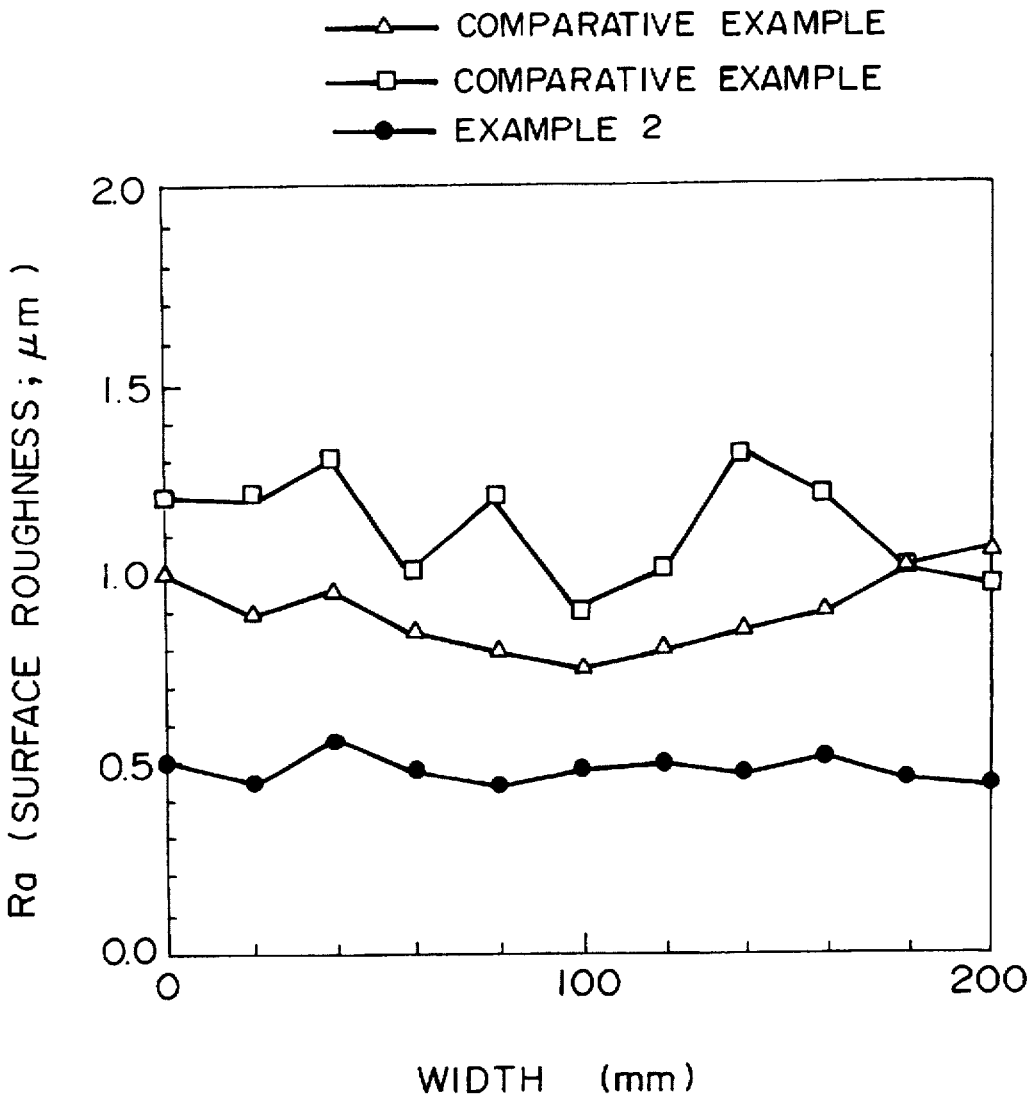
FIG. 7 shows the surface roughness distribution of a second example of a ribbon produced by practicing an embodiment of the present invention.

FIG. 7 also shows the results of two Comparative Examples. In one Comparative Example, the length L of the slit-shaped opening of the pressure header 5 was 70 mm, and the gas pressure and the depth d of the slit-shaped opening were the same as those of Example 1. In the other Comparative Example, ultrasonic waves were not applied to the atmosphere of the carbon dioxide gas.

Table 1 shows the results obtained such that the ribbons 4 were cast by altering the kind of blowing gases and the length L of the slit-shaped opening of the pressure header 5. The results of Example 2 and Comparative Examples are also shown in Table 1.

It is apparent from Table 1 and FIG. 7 that excellent properties are achieved in the ribbons 4 obtained by an apparatus and a manufacturing method of the present invention as compared with ribbons obtained by other apparatuses and manufacturing methods. In Table 1, B8 indicates the magnetic flux density (tesla) of the ribbons magnetized at 800 A/m.

TABLE 1

| No. | Examples | Blowing gases | Length of slit-shaped opening (mm) | Blowing methods | Ribbon roughness Ra (μm) | Magnetic flux density B8 (T) | Space factor (%) |
|---|---|---|---|---|---|---|---|
| 1 | Example 2 | $CO_2$ GAS | 220 | 2 headers | 0.45–0.55 | 1.542 | 88 |
| 2 | Comparative ex.* | $CO_2$ GAS | 70 | 2 headers | 0.80–1.00 | 1.54 | 85 |
| 3 | Comparative ex.* | $CO_2$ GAS | ultrasonic waves | 1 header | 0.90–1.30 | 1.5 | 80 |
| 4 | Comparative ex.* | $CO_2$ GAS | no header | replaced | 0.80–1.00 | 1.5 | 81 |
| 5 | Comparative ex.* | none | | | 1.20–1.80 | 1.49 | 77 |
| 6 | Comparative ex.* | Ar GAS | 220 | 1 header | 1.20–1.50 | 1.48 | 75 |
| 7 | Comparative ex.* | Ar GAS | 220 | 1 header | 1.50–1.80 | 1.44 | 76 |
| 8 | Comparative ex.* | air | 220 | 1 header | 1.00–1.20 | 1.45 | 75 |

*Comparative ex. means Comparative example.

EXAMPLES 3, 4, and 5

Ribbons 4 were cast from a molten metal alloy under the same conditions as those of Example 2, except that the flow rate for blowing the carbon dioxide gas 6 was altered. In these examples, the carbon dioxide gas 6 was blown at a preferable flow rate of the present invention. In other words, the flow rate was selected to satisfy the above-explained equation of $N \cdot W/140 \leqq Q \leqq N \cdot W/50$. In practice, the flow rate of 1.5 $Nm^3$/min was employed for these examples.

As a result of the air layer absorbed onto the surface of the roll 2, an approximately 10 μm thick layer was destroyed by a so-called knife effect of the carbon dioxide gas, and another 10 μm thick layer was destroyed by the ultrasonic effect.

Table 2 shows the results obtained such that the ribbons 4 were cast by altering the kind of blowing gases and the length L of the slit-shaped opening of the pressure header 5. The results of Examples 3, 4 and 5 and Comparative Examples are also shown in Table 2.

It is apparent from Table 2 that, as compared with the results of Examples 1 and 2, further excellent properties are achieved in the ribbons 4 by selecting the appropriate blowing quantity of the carbon dioxide gas 6 incorporated into the present invention.

In Table 2, $W_{13/50}$ indicates the core loss (W/kg) of the ribbons, when being magnetized at 50 Hz, as having a maximum magnetic flux density of 1.3 tesla.

the slit-shaped opening 10 of one of the headers 5 positioned upstream, sucked and removed by the suction box 12, and the carbon dioxide gas 6 was jetted from one of the headers 5 positioned downstream. The flow rate of the dry air 11 and the carbon dioxide gas 6 was 1.5 $Nm^3$/min.

Table 3 shows the result of casting. In addition to the result of Example 6, the results of other castings conducted by conventional apparatuses and manufacturing methods are also shown as Comparative Examples in Table 3.

Figure 9:
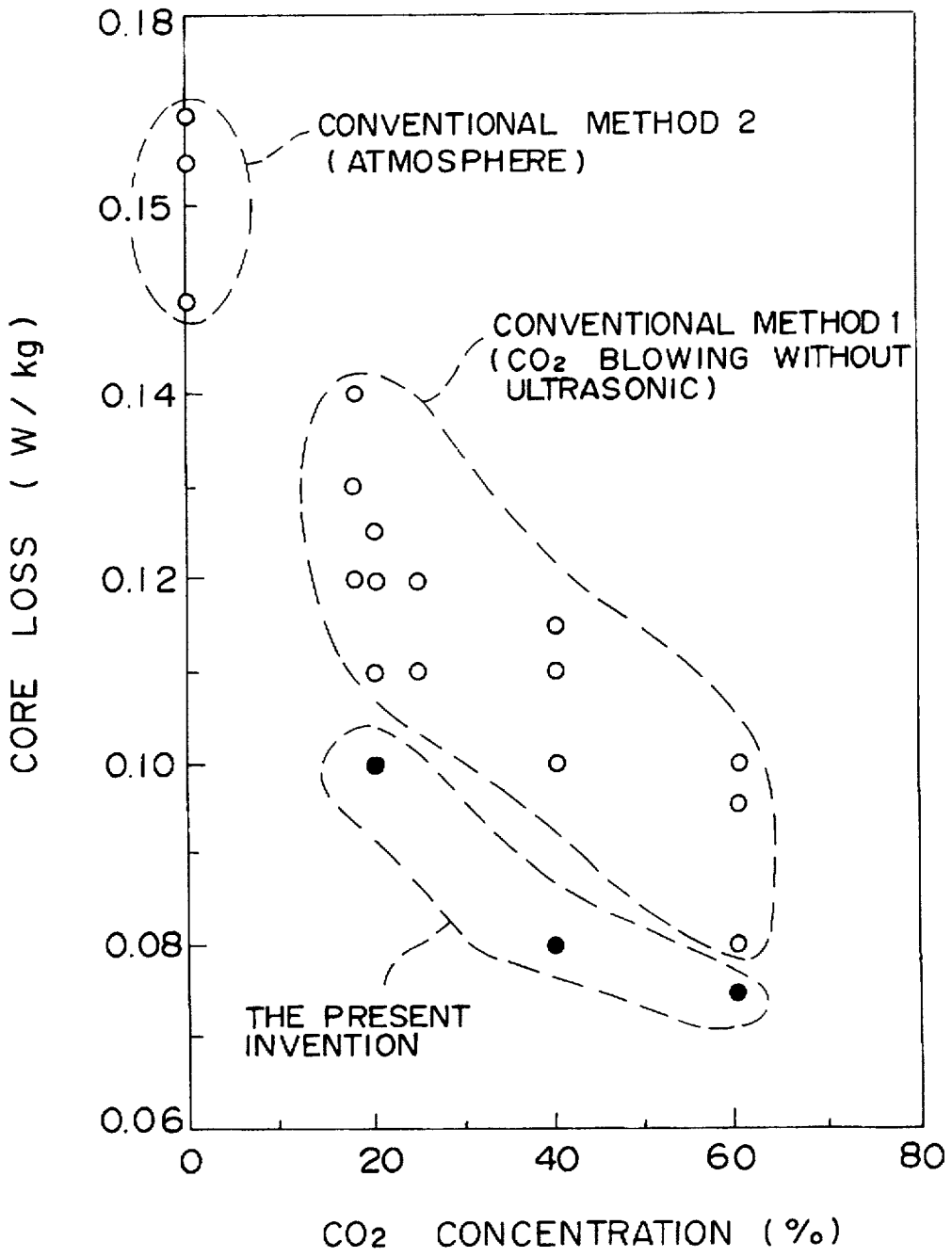
FIG. 9 shows the core loss of an example of amorphous alloy ribbons obtained by practicing an embodiment of the present invention and comparative examples.
Figure 10A:
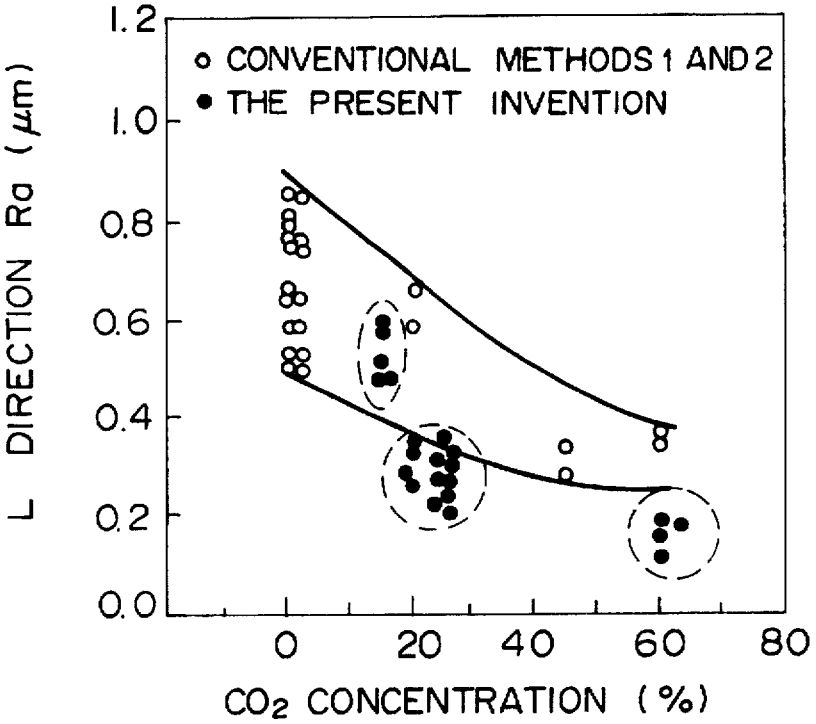
FIG. 10A shows the surface roughness in the L direction of an example of amorphous alloy ribbons obtained by practicing an embodiment of the present invention and comparative examples.
Figure 10B:
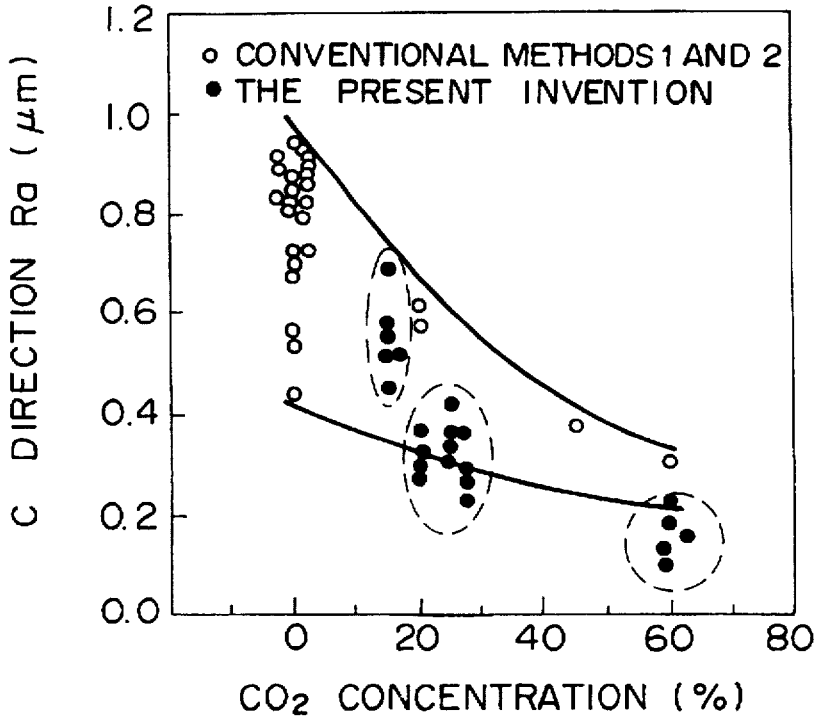
FIG. 10B shows the surface roughness in the C direction of an example of amorphous alloy ribbons obtained by practicing an embodiment of the present invention and comparative examples.

It is apparent from Table 3 that, as compared with the results of Comparative Examples, the ribbons 4 cast according to a method of the present invention in accordance with Example 6, provide excellent roughness, core loss, magnetic flux density and space factor. These attributes, based upon Example 6, are also illustrated in FIGS. 8 to 10.

Figure 8:
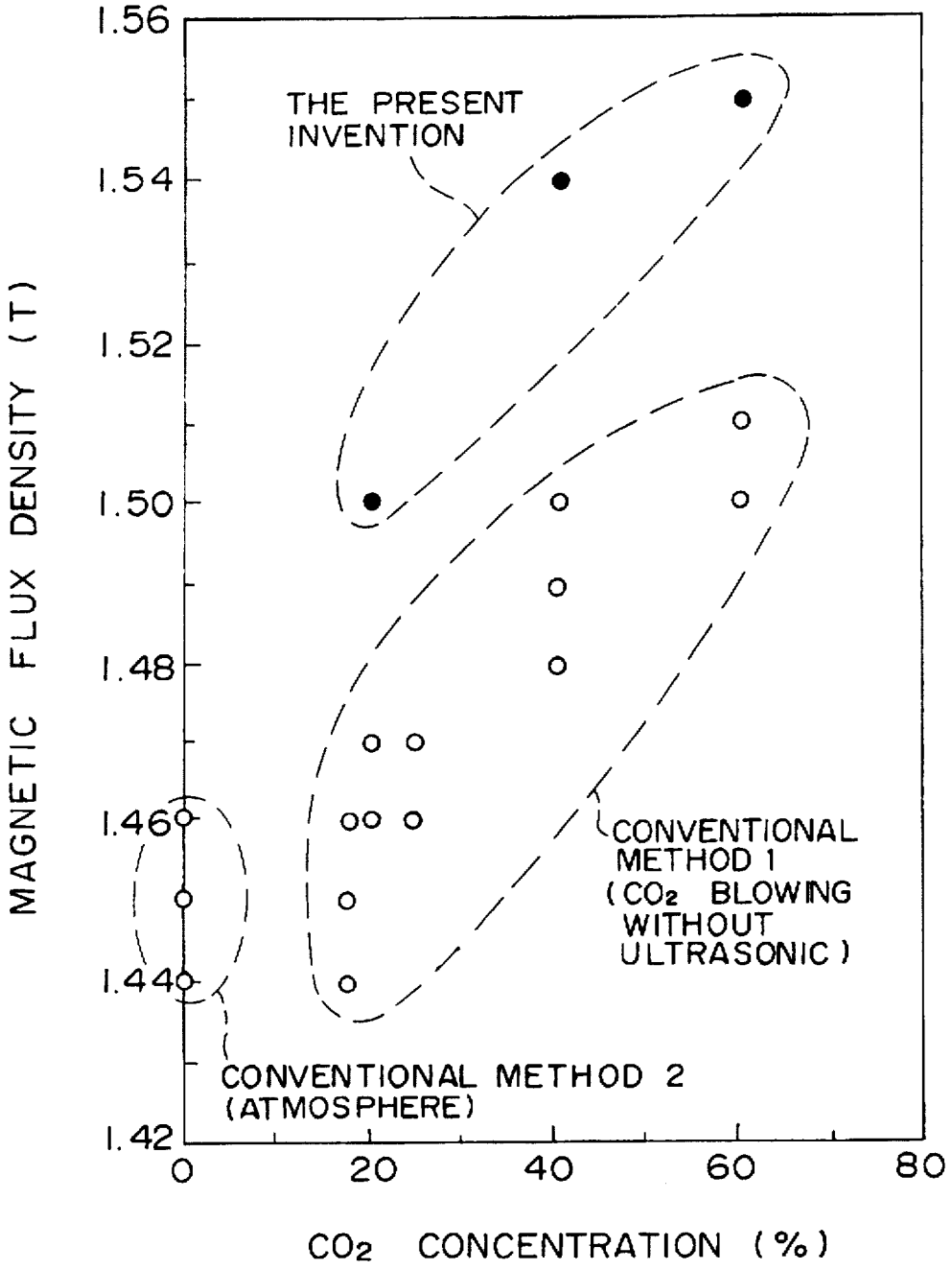
FIG. 8 shows the magnetic flux densities of an example of amorphous alloy ribbons produced by practicing an embodiment of the present invention and comparative examples.

FIG. 8 shows a comparison of the magnetic flux densities of the ribbons 4 obtained from Example 6 (ultrasonic waves+carbon dioxide gas blowing), Comparative Example 1 (carbon dioxide gas blowing without ultrasonic waves), and Comparative Example 2 (cast in a normal atmosphere). It is apparent from FIG. 8 that the magnetic flux dersities of the ribbons 4 obtained according to the present invention significantly increase as compared with those obtained by conventional methods. FIG. 9 shows a similar comparison in the core loss. It is understood from FIG. 9 that core loss of the ribbon 4 obtained according to the present invention significantly increases and the magnetism thereof is improved as compared with those obtained by conventional

TABLE 2

| No. | Examples | Blowing gases | Ribbon width (mm) | Flow rate ($Nm^3$/min) | Slit-shaped opening depth d (mm) | Blowing methods | Ribbon roughness Ra (μm) | Core loss $W_{13/50}$ (W/kg) | Core loss magnetic flux density B8 (T) |
|---|---|---|---|---|---|---|---|---|---|
| 9 | Example 3 | $CO_2$ GAS | 50 | 1.2 | 0.5 | one header | 0.3–0.5 | 0.070 | 1.545 |
| 10 | Example 4 | $CO_2$ GAS | 200 | 3 | 0.5 | one header | 0.3–0.5 | 0.065 | 1.547 |
| 11 | Example 5 | $CO_2$ GAS | 250 | 3.5 | 0.2 | one header | 0.3–0.5 | 0.072 | 1.546 |
| 12 | Comparative example | $CO_2$ GAS | 200 | 4 | 1.0 | one header | 0.8–1.0 | 0.12 | 1.48 |
| 13 | Comparative example | $CO_2$ GAS | 20 | 0.5 | 0.5 | one header | 0.9–1.3 | 0.1 | 1.5 |
| 14 | Comparative example | $CO_2$ GAS | 200 | 3 | no header | replaced | 0.8–1.0 | 0.093 | 1.5 |
| 15 | Comparative example | none | 200 | without blowing | without blowing | without blowing | 1.2–1.8 | 0.12 | 1.49 |
| 16 | Comparative example | Ar Gas | 200 | 3 | 0.5 | one header | 1.2–1.5 | 0.15 | 1.48 |
| 17 | Comparative example | $N_2$ GAS | 200 | 3 | 0.5 | one header | 1.5–1.8 | 0.16 | 1.44 |
| 18 | Comparative example | air | 200 | 3 | 0.7 | one header | 1.0–1.2 | 0.11 | 1.45 |

EXAMPLE 6

In Example 6, the surface of the roll 2 was cleaned by dry air before blowing the carbon dioxide gas 6, and then the ribbons 4 were cast from a molten metal alloy under almost the same conditions as those of Example 1, except for the following conditions: the gas pressure inside the pressure header 5 was 0.3 $kgf/cm^2$ and the pressure head 5 was positioned upstream the puddle 3 at a circumferential distance of 150 mm in a direction opposite the direction of rotation of the roll 2. The integral pressure header 5 shown in FIG. 4 was used, in which the dry air 11 was jetted from methods. FIG. 10A shows the surface roughness Ra (μm) of the ribbons 4 in the L direction and FIG. B shows the surface roughness Ra (μm) of the ribbons 4 in the C direction. It is apparent from FIGS. A and B that the surface roughness of the resultant ribbons 4 is significantly improved by applying the present invention.

As is mentioned above, amorphous metal ribbons having excellent surface properties can be advantageously produced at low costs and in safety on an industrial scale. As a result, the present invention is expected to supply low-priced amorphous metal ribbons advantageously used for transformers.

TABLE 3

| No. | Example | Blowing gases | Blowing methods | Ribbon roughness Ra (μm) | Core loss $W_{13/50}$ (W/kg) | Magnetic flux density B8, (T) | Space factor (%) |
|---|---|---|---|---|---|---|---|
| 19 | Example 6 | dry air + $CO_2$ GAS | 2 headers + suction | 0.2–0.4 | 0.069 | 1.55 | 89 |
| 20 | Comparative example | $CO_2$ GAS | 2 headers + suction | 0.5–0.7 | 0.098 | 1.501 | 89 |
| 21 | Comparative example | dry air | 2 headers + suction | 0.8–1.0 | 0.105 | 1.500 | 80 |
| 22 | Comparative example | $CO_2$ GAS | 1 header | 0.9–1.1 | 0.120 | 1.480 | 75 |
| 23 | Comparative example | dry air | 1 header | 1.0–1.3 | 0.150 | 1.460 | 73 |
| 24 | Comparative example | none | | 1.2–1.8 | 0.155 | 1.45 | 70 |
| 25 | Comparative example | Ar GAS | 2 headers + suction | 1.2–1.5 | 0.140 | 1.48 | 76 |
| 26 | Comparative example | Ar GAS | no header | 1.4–2.0 μm | 0.180 | 1.462 | 70 |

What is claimed is:

1. A method for manufacturing an amorphous metal ribbon, comprising the steps of:

jetting a molten metal from a nozzle, which has a slit-shaped opening, to a cooling roll, which rotates at a high speed, so as to form a puddle on said cooling roll; and spreading said puddle for rapid solidification;

cleaning a surface of said cooling roll at a position upstream from said puddle, opposite the direction of rotation of said cooling roll, by blowing carbon dioxide gas to which ultrasonic vibration is applied through at least one slit.

2. A method for manufacturing an amorphous metal ribbon according to claim 1, wherein said carbon dioxide gas is uniformly blown to a blowing region of the surface of said cooling roll.

3. A method for manufacturing an amorphous metal ribbon according to claim 1, wherein the flow rate of said carbon dioxide gas satisfies the following equation:

$$N \cdot W/140 \leqq Q \leqq N \cdot W/50$$

wherein Q is the flow rate of said carbon dioxide gas ($Nm^3$/min), W is the width of the ribbon (mm), and N is the number of slits.

4. A method for manufacturing an amorphous metal ribbon according to claim 1, wherein before blowing said carbon dioxide gas, the surface of said cooling roll is cleaned by blowing dry air to which ultrasonic vibration is applied and the contaminated dry air is removed by suction.

5. A method for manufacturing an amorphous metal ribbon according to claim 1, wherein the carbon dioxide gas is blown from a pressure header, and the carbon dioxide gas inside said pressure header has pressure set to about 10 to 30 kPa.

6. An apparatus for manufacturing an amorphous metal ribbon comprising:

a cooling roll rotating at a high speed; and a nozzle having a slit-shaped opening from which a molten metal is jetted onto said cooling roll to form a puddle;

at least one pressure header which has a built-in ultrasonic generator positioned upstream from said puddle in a direction opposite the direction of rotation of said cooling roll and including a source of carbon dioxide for blowing carbon dioxide gas, having ultrasonic vibration applied to it, to the surface of said cooling roll.

7. An apparatus for manufacturing an amorphous metal ribbon according to claim 6, wherein said at least one pressure header is positioned upstream from said puddle at a circumferential distance of about 20 mm to 200 mm, both inclusive, in a direction opposite the direction of rotation of said cooling roll.

8. An apparatus for manufacturing an amorphous metal ribbon according to claim 6, wherein said slit-shaped opening of said at least one pressure header has a length set to about 1 to 1.4 times a width of the ribbon to be cast and said slit-shaped opening has a depth set to about 0.2 to 0.7 mm.

9. An apparatus for manufacturing an amorphous metal ribbon according to claim 6, wherein a plurality of pressure headers are provided along the direction of rotation of said cooling roll and a suction box is provided between two adjacent pressure headers so as to remove used gas by suction.

10. An apparatus for manufacturing an amorphous metal ribbon according to claim 6, further comprising an air header, which has a built-in ultrasonic generator and which blows dry air to the surface of said cooling roll; and a suction box which removes the contaminated dry air by suction upstream from said pressure header in a direction opposite the direction of rotation of said cooling roll.

* * * * *